US010179260B1

(12) United States Patent
Stearns et al.

(10) Patent No.: US 10,179,260 B1
(45) Date of Patent: Jan. 15, 2019

(54) CLIMBING EXERCISE APPARATUS

(71) Applicants: Kenneth W Stearns, Houston, TX (US); Joseph D Maresh, West Linn, OR (US)

(72) Inventors: Kenneth W Stearns, Houston, TX (US); Joseph D Maresh, West Linn, OR (US)

( * ) Notice: Subject to any disclaimer, the term of this patent is extended or adjusted under 35 U.S.C. 154(b) by 0 days.

(21) Appl. No.: 15/361,368

(22) Filed: Nov. 25, 2016

Related U.S. Application Data

(60) Provisional application No. 62/386,273, filed on Nov. 24, 2015.

(51) Int. Cl.
*A63B 22/04* (2006.01)
*A63B 21/00* (2006.01)

(52) U.S. Cl.
CPC ..... *A63B 22/04* (2013.01); *A63B 21/4034* (2015.10); *A63B 21/4035* (2015.10); *A63B 21/4045* (2015.10)

(58) Field of Classification Search
CPC ..... A63B 2022/0043; A63B 21/012; A63B 22/00; A63B 22/205; A63B 23/03575; A63B 23/0417; A63B 22/04; A63B 21/4034; A63B 21/4035; A63B 21/4045
USPC ..... 482/52
See application file for complete search history.

(56) References Cited

U.S. PATENT DOCUMENTS 568,024 A * 9/1896 Gorman ..... A41D 13/085 125/40
3,381,958 A * 5/1968 Gulland ..... A63B 22/001 482/37
4,958,830 A * 9/1990 Huggins ..... A61H 1/0259 482/51
5,000,441 A * 3/1991 Wang ..... A63B 22/0002 482/112
5,007,631 A * 4/1991 Wang ..... A63B 22/001 482/119
5,037,088 A * 8/1991 Bernstein ..... A63B 21/0004 482/112
5,040,785 A * 8/1991 Charnitski ..... A63B 22/001 482/51
D323,008 S * 1/1992 Wang ..... D21/670
5,090,690 A * 2/1992 Huang ..... A63B 22/0002 482/131
5,167,596 A * 12/1992 Ferber ..... A63B 21/0004 482/114
5,169,361 A * 12/1992 Hsu ..... A63B 21/0083 482/111
5,199,932 A * 4/1993 Liao ..... A63B 22/001 482/113
5,222,927 A * 6/1993 Chang ..... A63B 21/0552 482/126

(Continued)

*Primary Examiner* — Andrew S Lo
(74) *Attorney, Agent, or Firm* — Nick A Nichols, Jr.

(57) ABSTRACT

An exercise apparatus having homolateral and contralateral modes of operation is disclosed. The exercise apparatus may include a frame supporting generally vertically oriented reciprocating members spaced apart and in substantial parallel relationship to one another. The reciprocating members may include foot supports fixedly secured at the lower distal ends thereof and handlebars rotatably mounted proximate the upper distal ends of the reciprocating members. The handlebars may be selectively locked for homolateral and contralateral operation of the exercise apparatus.

6 Claims, 9 Drawing Sheets

(56) References Cited

U.S. PATENT DOCUMENTS

| | | | | | |
|---|---|---|---|---|---|
| 5,295,927 | A * | 3/1994 | Easley | A63B 21/015 | 482/51 |
| D355,228 | S * | 2/1995 | Hung | D21/670 | |
| 5,492,515 | A * | 2/1996 | Charnitski | A63B 22/001 | 482/37 |
| 5,803,880 | A * | 9/1998 | Allen | A63B 21/0087 | 482/113 |
| 5,820,520 | A * | 10/1998 | Sieber | A63B 23/0227 | 482/148 |
| 5,928,115 | A * | 7/1999 | Arroyo, Jr. | A63B 22/0002 | 482/51 |
| 7,867,152 | B1 * | 1/2011 | Harris, Jr. | A63B 21/0083 | 482/112 |
| 9,205,297 | B2 * | 12/2015 | Kaehler | A63B 21/02 | |
| D759,169 | S * | 6/2016 | Humberto Mercenari Uribe | D21/670 | |
| 9,650,101 | B2 * | 5/2017 | Desberg | B62K 21/26 | |
| 2013/0210587 | A1 * | 8/2013 | Shank | A63B 25/08 | 482/77 |
| 2015/0111702 | A1 * | 4/2015 | Kahmann | A63B 22/04 | 482/54 |
| 2015/0343259 | A1 * | 12/2015 | Mercenari Uribe | A63B 22/0066 | 482/52 |
| 2015/0367166 | A1 * | 12/2015 | Lagree | A63B 21/4001 | 482/123 |
| 2016/0256733 | A1 * | 9/2016 | Lagree | A63B 21/023 | |

* cited by examiner

BR
BL
216
134
200
128
214
125
135
BL
129
124
134
125
119

BR
216
134
210
212
214
214
135
128
129
128
125
124

CLIMBING EXERCISE APPARATUS

CROSS-REFERENCE TO RELATED APPLICATION

This application claims the benefit of U.S. Provisional Application Ser. No. 62/386,273, filed Nov. 24, 2015, which application is incorporated herein in its entirety by reference.

BACKGROUND

The present invention relates to fitness equipment, more particularly to exercise apparatus where the exercise paths are substantially vertical and parallel to each other.

During exercise machine climbing activities two coordinated body movements are generally possible. A first motion may be referred to as homolateral movement where an asymmetrical movement of the upper limb and the lower limb on the same side occurs, and a second motion referred to as contralateral movement where a diagonal movement of an upper limb with the opposite lower limb occurs. The first motion of homolateral movement or straight climbing is more closely correlated with martial arts where martial arts typically employ homolateral movements, whereas the second motion of asymmetrical or cross climbing action is more closely correlated with oppositional exercises such as swimming and walking. In homolateral motion the body halves do not cooperate but move separately, and in contralateral motion both sides of the brain function at the same time in a coordinated manner.

SUMMARY

An exercise apparatus having homolateral and contralateral modes of operation may include a frame supporting generally vertically oriented reciprocating members spaced apart and in substantial parallel relationship to one another. The reciprocating members may include foot supports fixedly secured at the lower distal ends thereof, and handlebars rotatably mounted proximate the upper distal ends of the reciprocating members. The handlebars may be selectively locked for homolateral and contralateral operation of the exercise apparatus.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
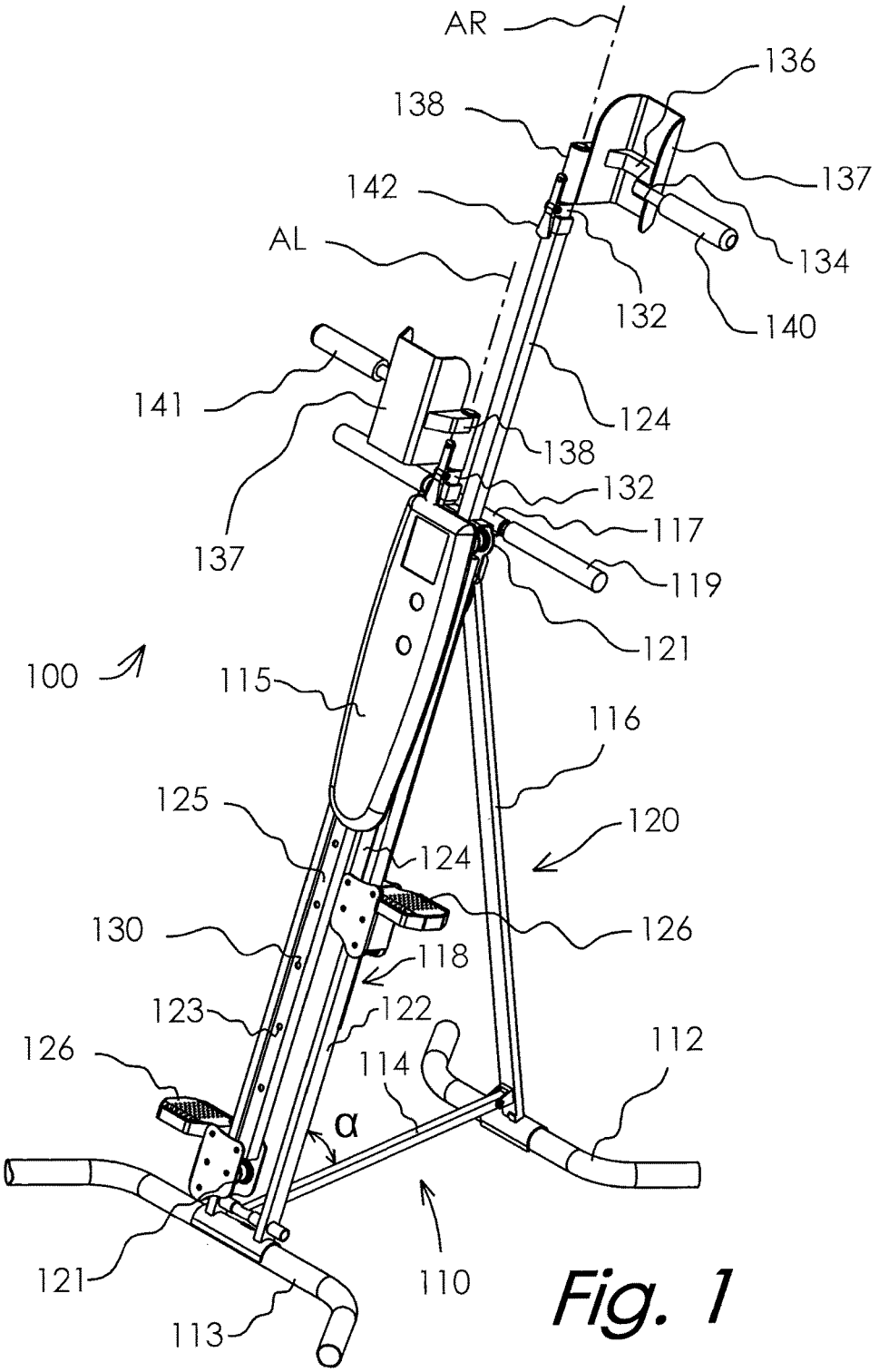
FIG. 1 is a perspective view of a climbing exercise apparatus.
Figure 2:
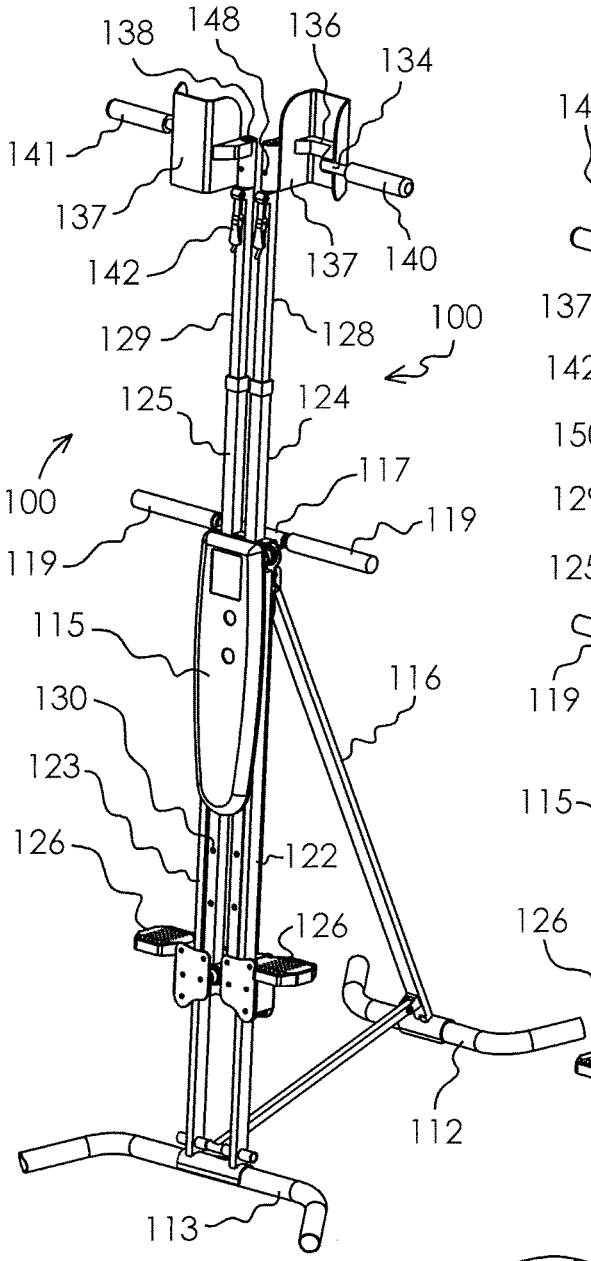
FIG. 2 is a perspective view of the climbing exercise apparatus shown in FIG. 1 configured for operation in the homolateral mode.
Figure 3:
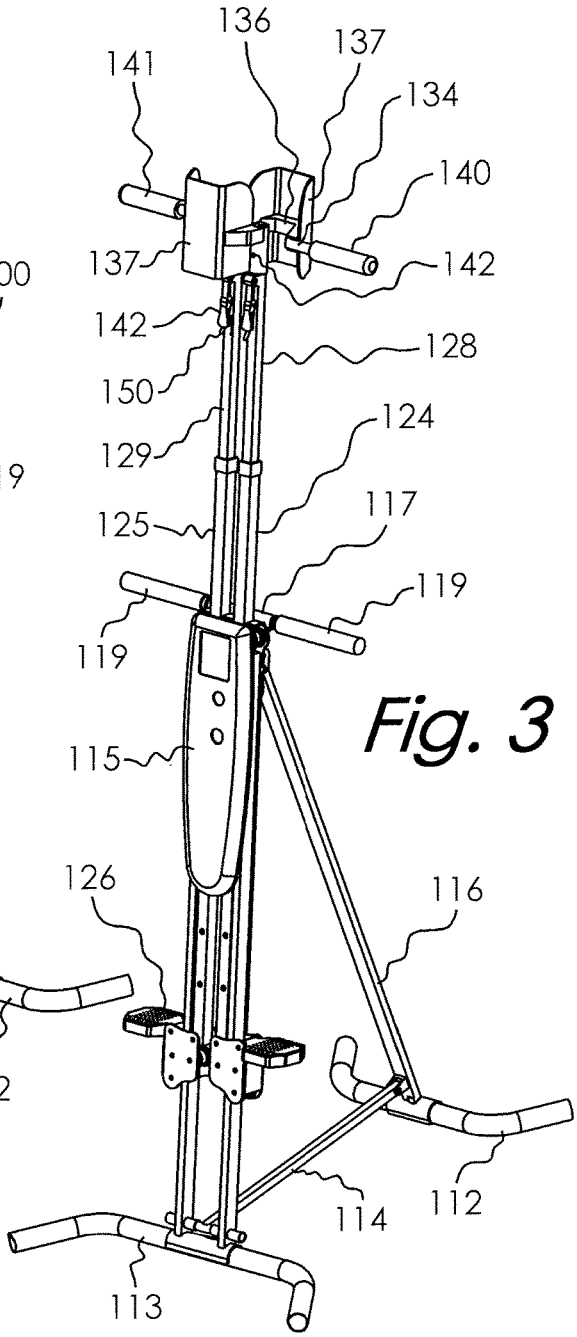
FIG. 3 is a perspective view of the climbing exercise apparatus shown in FIG. 1 configured for operation in the contralateral mode.
Figure 4A:
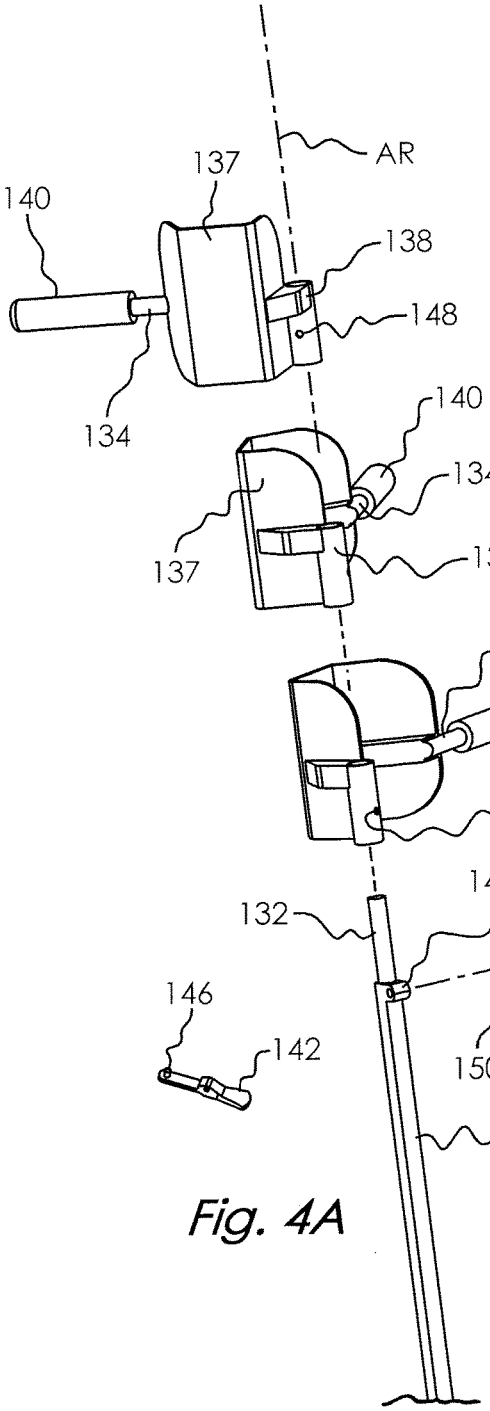
FIG. 4A is a partial explode view of the climbing exercise apparatus shown in FIG. 1 illustrating rotational positions of a handlebar of the exercise apparatus.
Figure 4B:
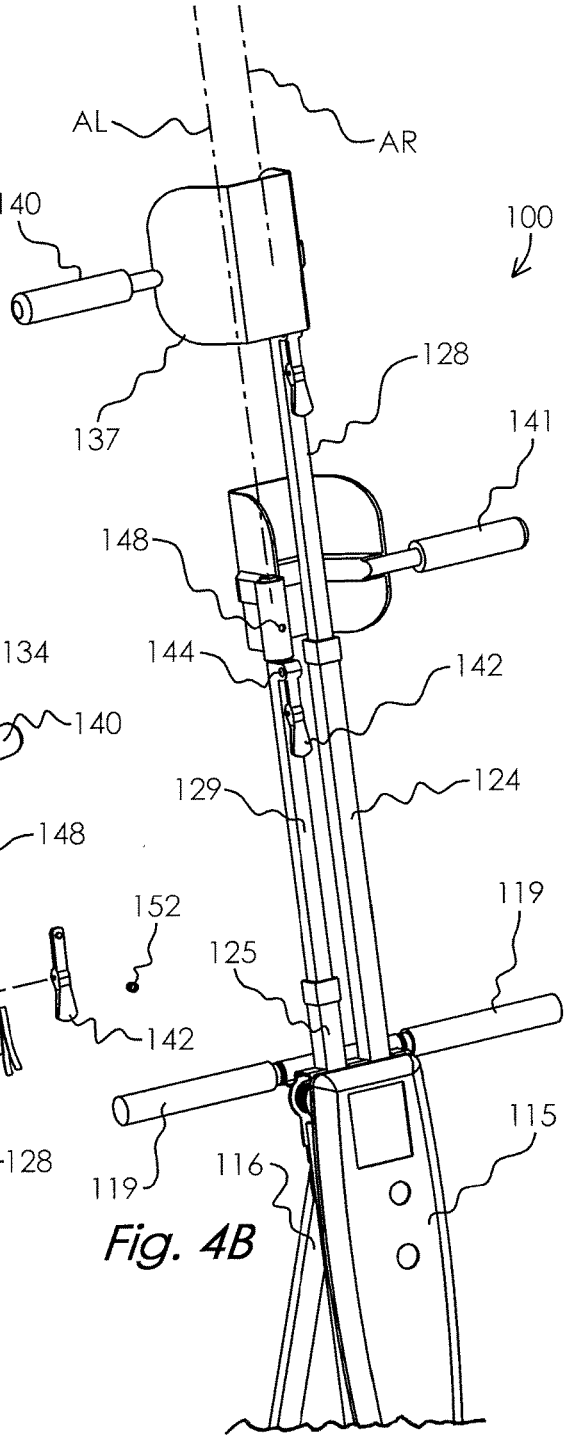
FIG. 4B is a partial perspective view of the climbing exercise apparatus shown in FIG. 1.

Referring first to FIGS. 1-4, a climbing exercise apparatus is generally identified by the reference numeral 100. The apparatus 100 may include a base 110 comprising spaced apart base members 112, 113 interconnected by a cross connect member 114. A generally vertically extending stanchion 116 and generally vertically extending frame subassembly 118 may be fixedly secured to the base members 112, 113, respectively. The stanchion 116 and frame subassembly 118 join at the upper distal ends thereof at a transverse frame member 117 to form a generally triangularly shaped frame 120. The frame subassembly 118 may extend upwardly from the base member 113 generally toward the base member 112 at an angle $\alpha$ of about fifteen (15°) degrees. The frame member 117 may include fixed hand grip portions 119 that a user may grasp to steady himself on the apparatus 110 or while reciprocating only his legs in an up and down motion.

The frame subassembly 118 may include spaced apart substantially parallel track members 122, 123 movably supporting a pair of elongated reciprocating members 124, 125, respectively. The reciprocating members 124, 125 are depicted in the drawings as having a substantially rectangular cross section and are hereinafter referred to as "bar members." It will be appreciated, however, that the terms "bar members" are to be broadly interpreted to include other cross sectional shapes, such as, but without limitation, circular, cylindrical, triangular and the like cross sectional shapes. The bar members 124, 125 may linearly reciprocate relative to the track members 122, 123 on rollers or slide members 121 and the like in a manner known in the art. Foot supports or pedals 126 may be secured proximate the lower distal ends of the bar members 124, 125, generally in a non-adjustable manner. A cover or shroud 115 may be secured to the subassembly 118 to cover or enclose the central portion of the apparatus.

The bar members 124, 125 may be configured for receipt of telescoping bar members 128, 129, respectively. The bar members 124, 125 may include vertically spaced detent holes 130 for selectively adjusting the position of the telescoping bar members 128, 129 relative to the bar members 124, 125. The telescoping bar members 128, 129 may include an outwardly biased member, such as, but without limitation, an outwardly biased pin and the like known in the art (not shown in the drawings) for selective engagement with the detent holes 130 to adjust the relative positions of the bar members 124, 124 and telescoping bar members 128, 129 to accommodate the arm reach of a user. The upper distal ends of the bar members 128, 129 may terminate in a rounded cylindrical shaft or bearing surface 132.

Handlebars 134, 135 may be rotatably connected proximate the upper distal ends of the bar members 128, 129, respectively. The handlebars 134, 135 may include a laterally offset portion 136 terminating in a substantially cylindrical journal 138 rotatably secured and concentric with the bearing surface 132 of the bar members 128, 129. The handlebars 134, 135 may include hand grips 140, 141, respectively. A shield 137 may be fixedly secured about the offset portion 136 of the handlebar members 134, 135. The shield 137 may be provided to minimize pinch point concerns for the user during operation of the apparatus 100.

Right handlebar 134 is rotatable about axis AR, and left handlebar 135 is rotatable about axis AL. The handlebars 134, 135 may be selectively secured one hundred and eighty degrees (180°) apart and may be rotated about the bearing surface 132 of the bar members 128, 129, respectively, and positioned for either homolateral movement or contralateral movement. For example, but without limitation, a detent release lever 142 may be rotatably secured to the handlebar members 128, 129 at a pivot connection 144. The detent release lever 142 may include a boss 146 which may be rotated into engagement with holes 148 in the journals 138 to releasably lock the handlebars 134, 135 for homolateral or contralateral movement. A biasing member, for example, but without limitation, a leaf spring 150 or compression spring 152 and the like, may be employed to apply a biasing force to the detent release levers 142 to lock the handlebars 134, 135 in a selected mode (straight climbing or cross climbing mode) during operation of the apparatus 100.

The handlebar journals 138 may include at least two holes 148 diametrically opposite each other. Referring now to the exploded view of FIG. 4A, three potential positions of the handlebar 134 are illustrated. In this example, it is assumed that the journal includes a third hole between the holes 148. In the first position (just above the handlebar member 128), the handlebar 134 extends outwardly to the right of the AR axis which the user may grasp with his right hand for homolateral (straight climbing mode) movement. In the second or intermediate position, the handlebar 134 may extend toward or away from the user for either homolateral or contralateral (cross climbing mode) movement. In the third position, the handlebar 134 extends to the left of the AR axis which the user may grasp with his left hand for contralateral movement. The handlebars 134, 135 may be rotated and locked in a desired position by depressing the detent release lever 142 to disengage the boss 146 from a hole 148 and then rotating the handlebars 134, 135 to a desired position and releasing the detent release lever 142. The biasing force applied by the biasing member 150, 152 rotated the detent release lever 142 about the pivot connection 144 forcing the boss 146 into engagement with the hole 148 corresponding to the desired locked position.

Figures 5A, 5B, 5C, 5D, 5E, 5F:
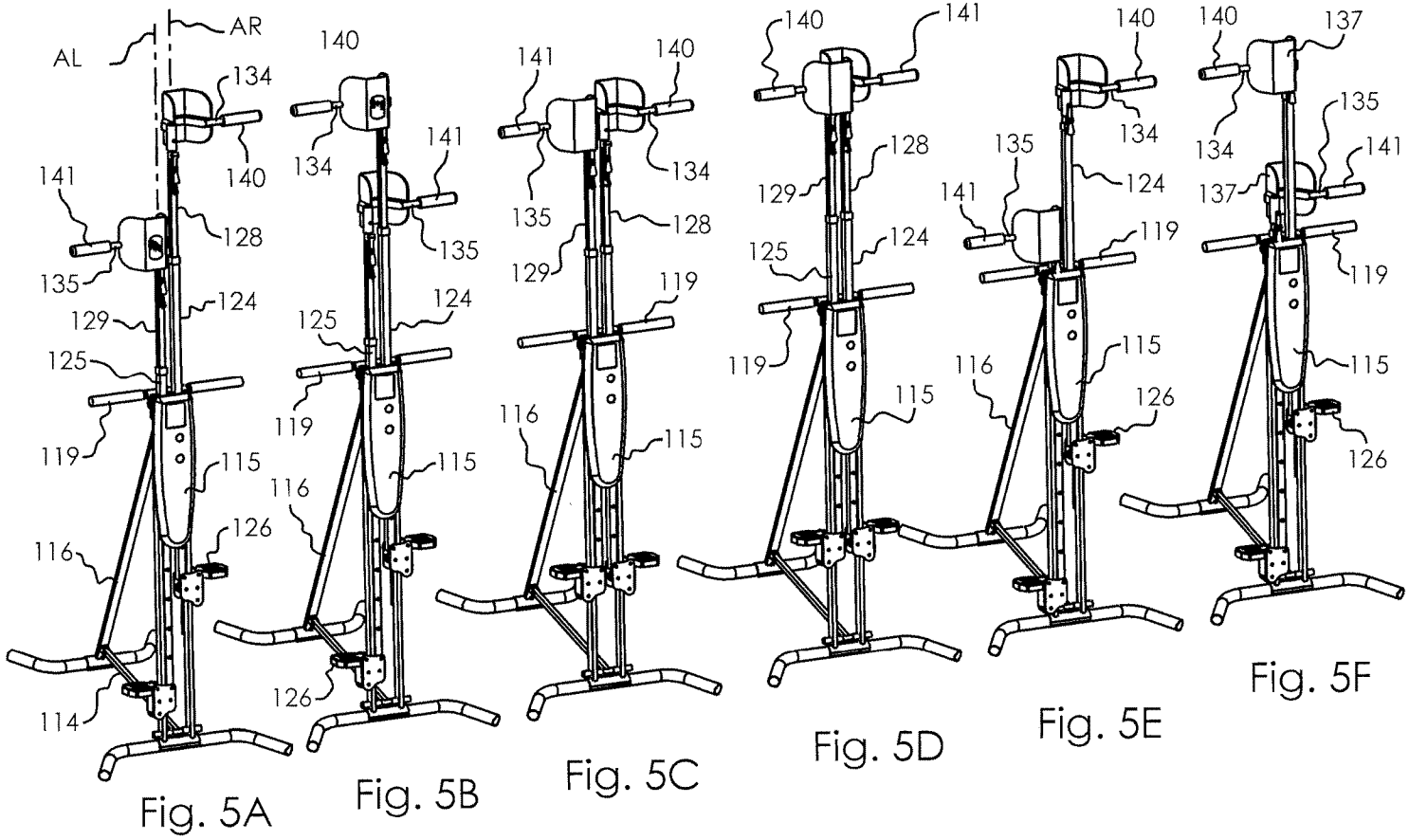
FIGS. 5A-5F are perspective view of the climbing exercise apparatus shown in FIG. 1 in various modes of operation.

Referring next to FIGS. 5A-5F, various orientations of the handlebars 134, 135 about the bar members 124, 125 are illustrated for homolateral and contralateral modes of operation of the apparatus 100. It will be observed that in FIGS. 5A, 5C and 5E, the apparatus 100 is configured for operation in the homolateral (straight climbing) mode with the right handlebar 134 extending to the right of the AR axis and the left handlebar 135 extending to the left of the LR axis. In FIGS. 5B, 5D and 5F, the apparatus 100 is configured for operation in the contralateral (cross climbing) mode with the right handlebar 134 extending to the left of the LR axis and the left handlebar 135 extending to the right of the AR axis.

Figures 6A, 6B, 6C:
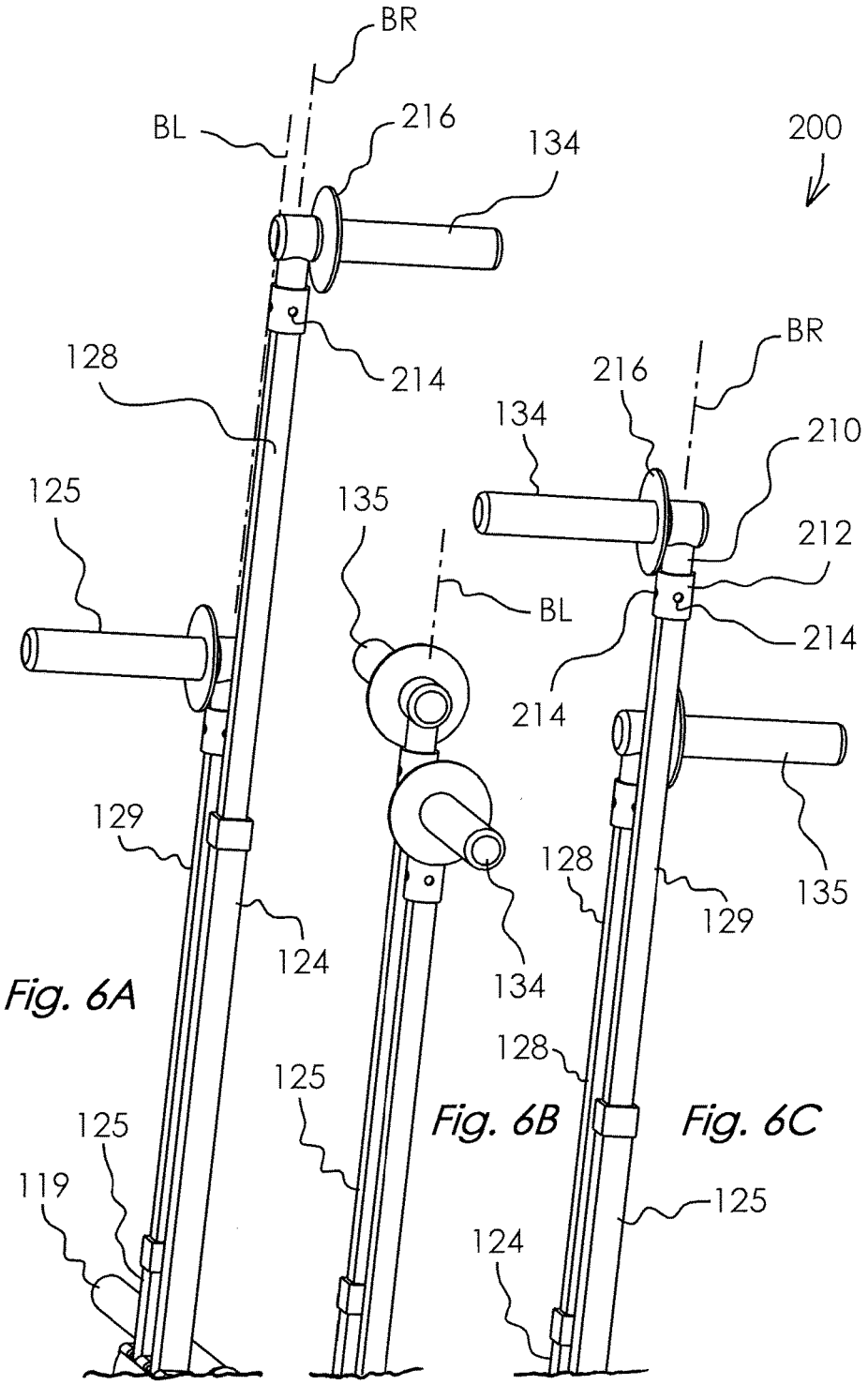
FIGS. 6A-6C are perspective views of a second embodiment of a climbing exercise apparatus.

Referring now to FIGS. 6A-6C, a second embodiment of a climbing exercise apparatus is generally identified by the reference numeral 200. As noted by use of common reference numerals, the apparatus 200 is similar to apparatus 100. The handlebars 134, 135 may be fixedly secured to a downwardly extending post 210 received in bar member journals 212 which may include two or more detent holes 214. An unillustrated boss member may be spring loaded in a radially outward direction for engagement with the detent holes 214. Depression of the boss member releases the handlebars 134, 135 for rotation to a different orientation. FIG. 5A illustrates the handlebars 134, 135 oriented in the straight climbing mode. FIG. 5C illustrates the handlebars 134, 135 oriented in the cross climbing mode. In the cross climbing mode, the user may prefer, for example, but without limitation, to grasp the left hand grip 141 with the right hand when the left hand grip 141 is either forward (FIG. 6C) or rearward (FIG. 6A) of the right hand grip 140, depending upon which detent hole 214 is used to lock the handlebars 134, 135 in a particular orientation. The preferences of individuals, whether right or left handed, may vary. Hand guards or shields 216 may be provided to minimize potential pinch points while operating the apparatus 200.

Figures 7A, 7B:
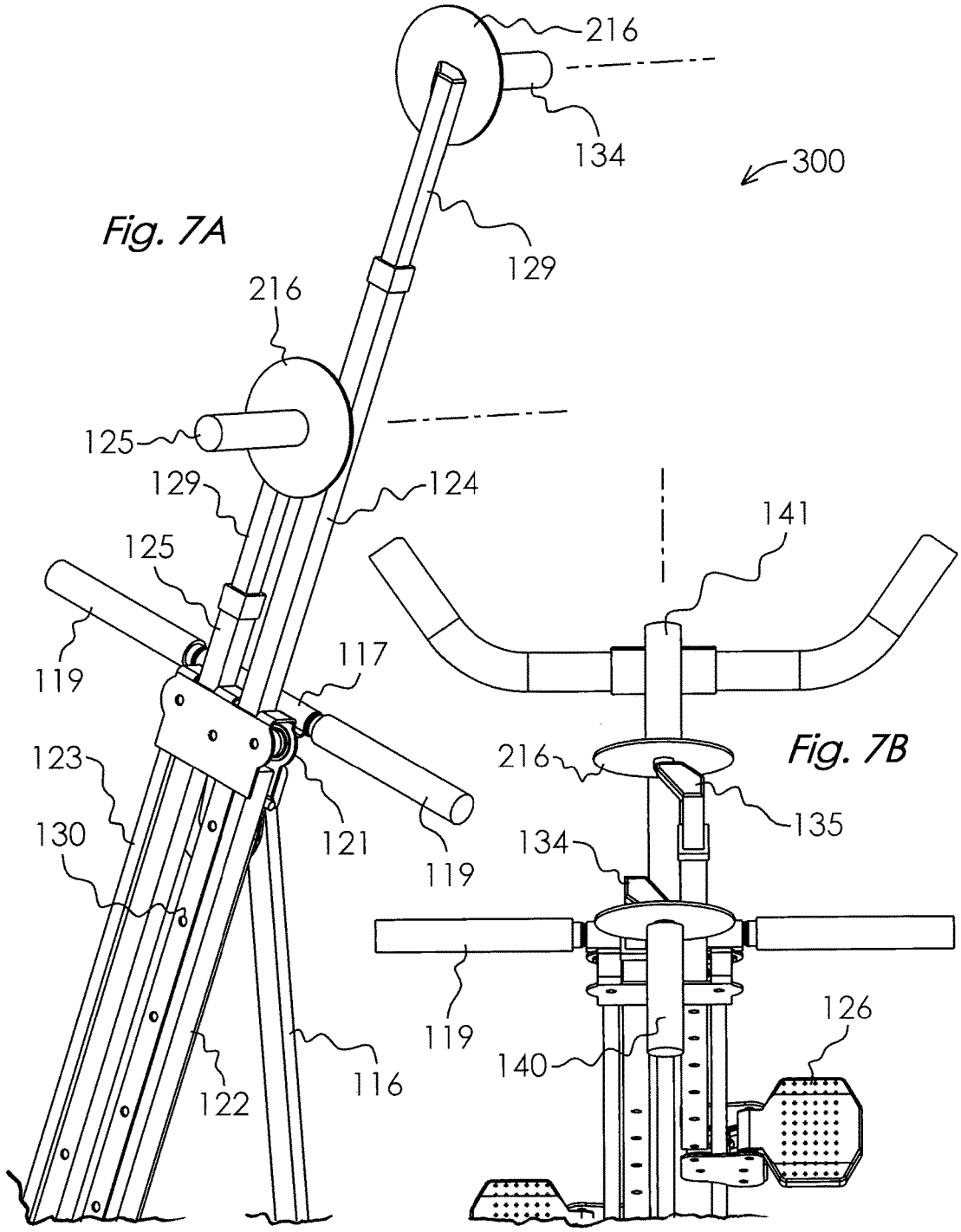
FIGS. 7A and 7B are partial perspective views of a third embodiment of a climbing exercise apparatus.

Referring now to FIGS. 7A and 7B, a third embodiment of a climbing exercise apparatus is generally identified by the reference numeral 300. As noted by use of common reference numerals, the apparatus 300 is similar to apparatus 200 with the exception that the handlebars 134, 135 are fixedly secured to the bar members 124, 125, respectively. The handlebars 134, 135 may be offset toward the center of the apparatus 300. In this configuration, the user may grasp either handlebar 134, 135 with either hand depending on whether straight or cross climbing movements are to be performed.

Figures 8A, 8B:
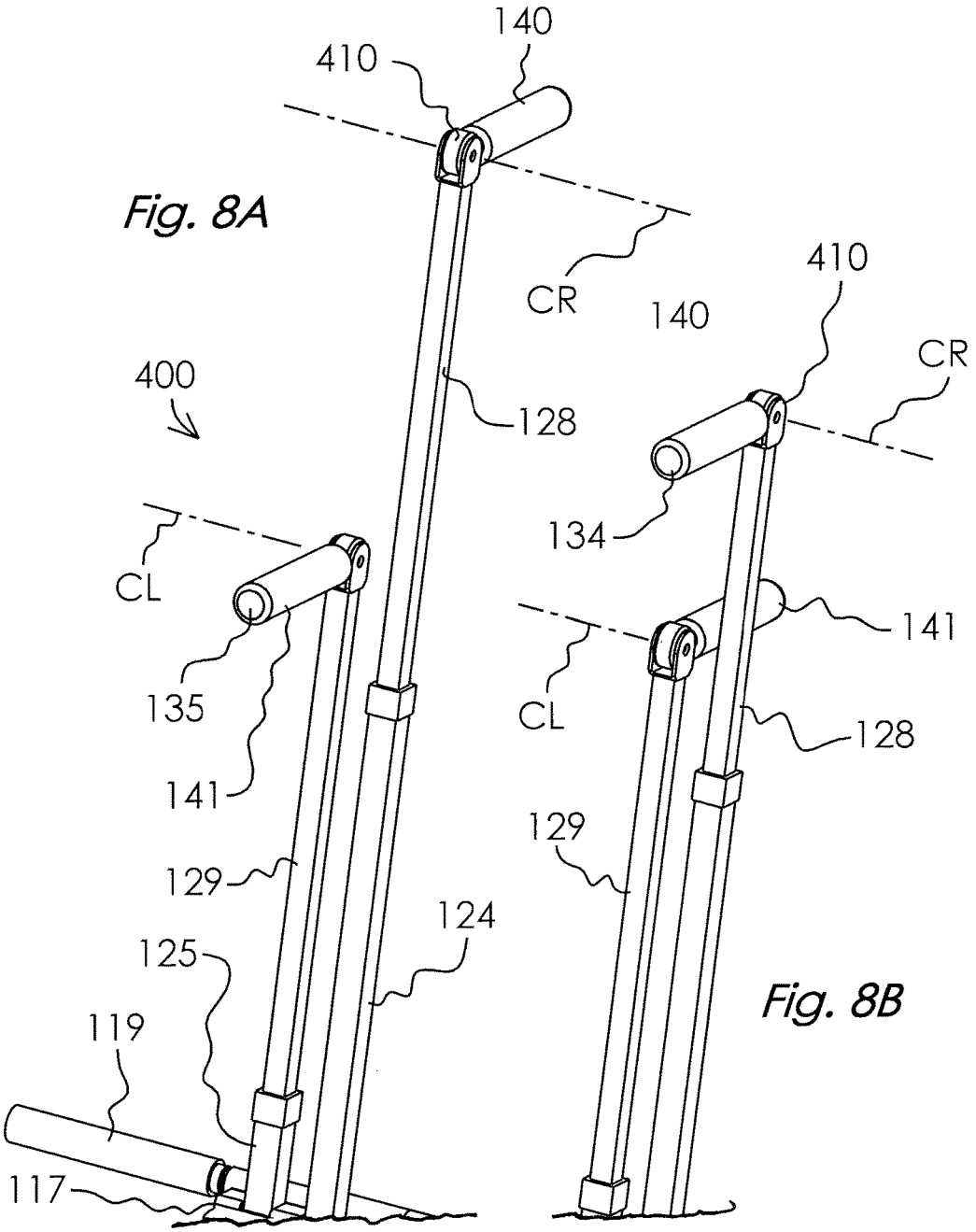
FIGS. 8A and 8B are partial perspective views of a fourth embodiment of a climbing exercise apparatus.

Referring now to FIGS. 8A and 8B, a fourth embodiment of a climbing exercise apparatus is generally identified by the reference numeral 400. As noted by the use of common reference numerals, the apparatus 400 is similar to apparatus 300 with the exception that the handlebars 134, 135 are rotatably secured to the bar members 124, 125, respectively, by a pivot shaft. The handlebars 134, 135 may rotate about transverse axes CR and CL, respectively. Detents or other means (not illustrated) may be provided to lock the handlebars 134, 135 for operation of the apparatus 400 in the straight or cross climbing modes. In the cross climbing mode, the user may prefer, for example, but without limitation, to grasp the left hand grip 141 with the right hand when the left hand grip 141 is oriented either rearward (FIG. 8A) or forward (FIG. 8B) of the right hand grip 140, depending upon which detent hole 214 is used to lock the handlebars 134, 135 in a particular orientation. Similarly, in the cross climbing mode, the user may grasp the right hand grip 140 with his left hand when the right hand grip 140 is directed either forward (FIG. 8A) or rearward (FIG. 8B) of the left hand grip 141. An unillustrated hand guard may be provided to minimize potential injuries that may occur at pinch points.

Figures 9A, 9B:
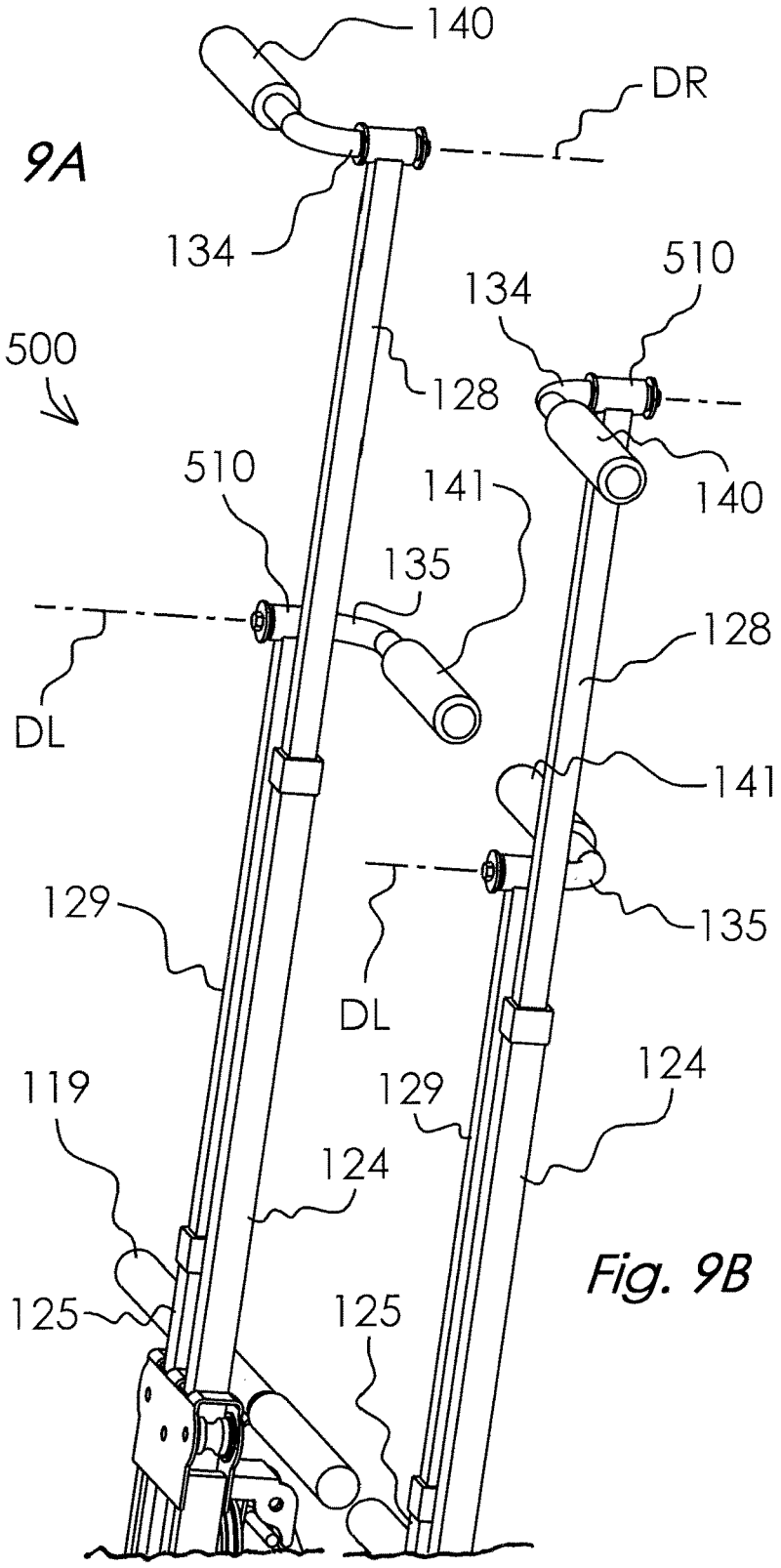
FIGS. 9A and 9B are partial perspective views of a fifth embodiment of a climbing exercise apparatus.

Referring now to FIGS. 9A and 9B, a fifth embodiment of a climbing exercise apparatus is generally identified by the reference numeral 500. As noted by the use of common reference numerals, the apparatus 500 is similar to apparatus 400. The handlebars 134, 135 are rotatably secured to the bar members 124, 125, respectively, and may rotate about axes DR and DL, respectively. Journals 510 may be fixedly secured to the bar members 124, 125 oriented transverse to the longitudinal axes of the bar members 124, 125. Biasing means, such as, but without limitation, unillustrated outwardly biased detents, may be provided to lock the handlebars 134, 135 for straight climbing and cross climbing modes of operation. FIG. 9A illustrates the handlebars 134, 135 rotatable about the axes DR and DL, respectively, to a first position for cross climbing mode of operation of the apparatus 500. FIG. 9B illustrates the handlebars 134, 135 rotated about the axes DR and DL, respectively, to a second position for straight climbing mode of operation of the apparatus 500. As in prior embodiments a hand guard (unillustrated in FIG. 9A and FIG. 9B) may be provided to minimize potential pinch points during operation of the apparatus 500.

Figures 10A, 10B:
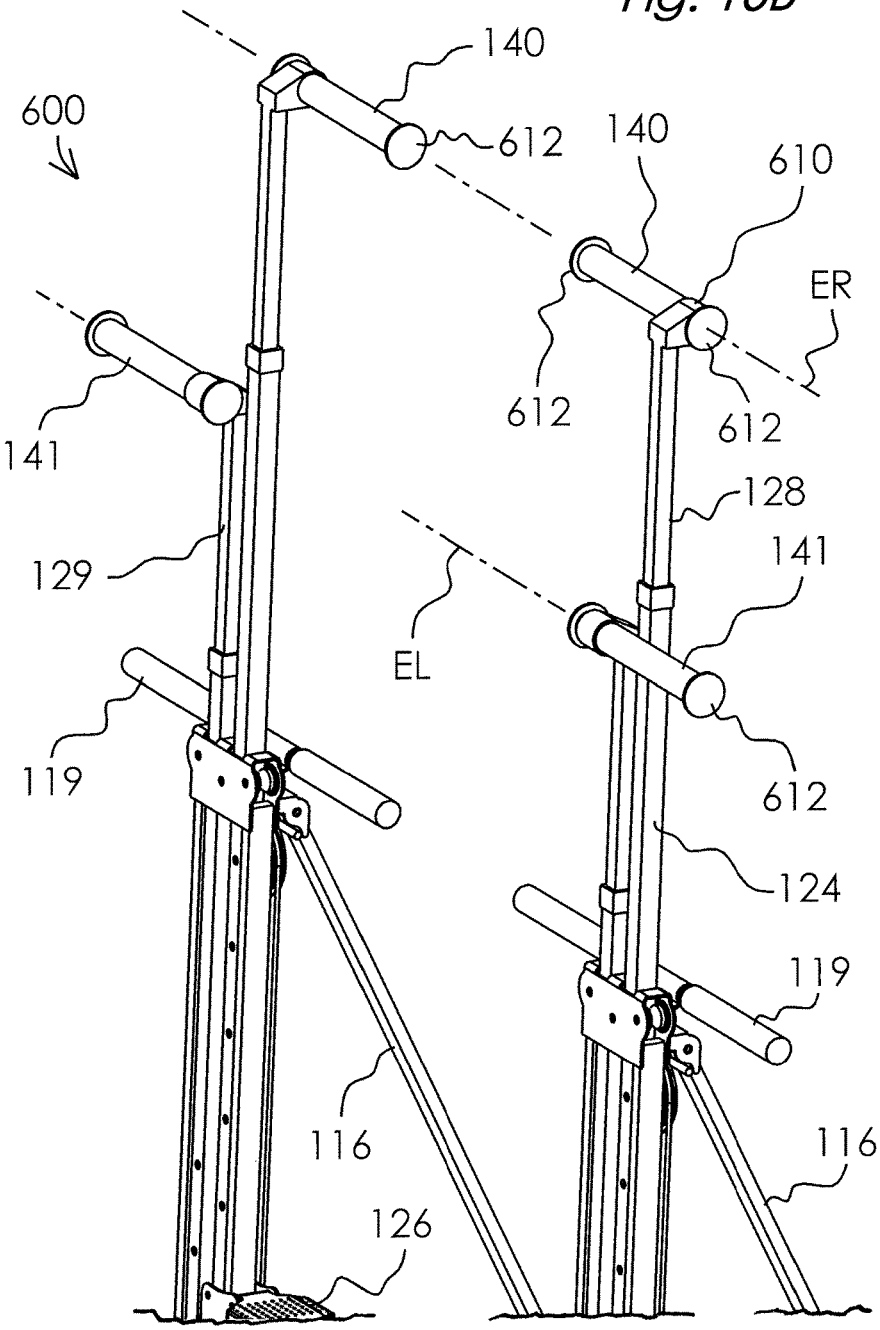
FIGS. 10A and 10B are partial perspective views of a sixth embodiment of a climbing exercise apparatus.

Referring now to FIGS. 10A and 10B, a sixth embodiment of a climbing exercise apparatus is generally identified by the reference numeral 600. As noted by the use of common reference numerals, the apparatus 600 is similar to apparatus 500. Journals 610 may be fixedly secured to the upper ends of the bar members 124, 125 and extend outwardly therefrom in opposite directions substantially perpendicular to the longitudinal axes of the bar members 124, 125. The handlebars 134, 135 may extend through the journals 610 and include stop members 612 at the opposite ends thereof. The handlebars 134,135 may slide along respective axes ER and EL offset and extending transverse to the longitudinal axes of the bar members 124, 125. FIG. 10A illustrates the handlebar 134, 135 slid along the axis ER to the right of the bar member 124 and the handlebar 135 slid along the axis EL to the left of the bar member 135 to a first position for straight climbing mode of operation of the apparatus 600. FIG. 10B illustrates the handlebar 134 slid along the ER axis to the left of bar member 124 and the handlebar 135 slid along the EL axis to the right of bar member 135 to a second position for cross climbing mode of operation of the apparatus 600.

While preferred embodiments of a climbing exercise apparatus have been shown and described herein, other and further embodiments may be devised without departing from the basic scope thereof, and the scope thereof is determined by the claims which follow.

The invention claimed is:

1. A climbing exercise apparatus, comprising:

a) a frame including a base, a stanchion extending generally vertically upward from said base and a generally vertically extending subassembly frame having a lower end secured to said base and an upper end secured to said stanchion, wherein said subassembly frame includes spaced apart substantially parallel track members;

b) an elongated bar member movably supported by a respective said track members;

c) an elongated telescopic member telescopically received by each said bar member, each said telescopic member being selectively adjustable relative to a respective said bar member;

d) a handlebar rotatably secured proximate an upper distal end of each said telescopic member, each said handlebar movable from a first horizontal position relative to a respective said telescopic member to a second horizontal position for either homolateral or contralateral movement and a release lever pivotally connected to each said telescopic member, said release lever configured to lock each said handlebar for either homolateral or contralateral movement; and e) a foot support secured proximate a lower distal end of each said bar member.

2. The exercise apparatus of claim 1 wherein each said handlebar is rotatable about an axial axis of a respective telescopic member in a plane transverse to said axial axis.

3. The exercise apparatus of claim 1 wherein each said bar member include vertically spaced detent holes for selectively positioning each said telescopic member relative to a respective said bar member.

4. The exercise apparatus of claim 1 wherein each said telescopic member includes a bearing surface proximate said upper distal end of each said telescopic, and wherein each said handlebar includes a distal end concentrically engaging said bearing surface of each said telescopic member.

5. The exercise apparatus of claim 1 wherein each said handlebar includes a shield member.

6. The exercise apparatus of claim 1 including a biasing member applying a biasing force to each said release lever configured to lock each said handlebar for either homolateral or contralateral movement.

* * * * *